US011199317B1

(12) United States Patent
Amonett et al.

(10) Patent No.: US 11,199,317 B1
(45) Date of Patent: Dec. 14, 2021

(54) LIGHT STICK BUS SYSTEM

(71) Applicant: Scott Fetzer SFEG, Fairview, TN (US)

(72) Inventors: Daniel K. Amonett, Murfeesboro, TN (US); Scott Cutcher, Franklin, TN (US)

(73) Assignee: SCOTT FETZER SFEG, Fairview, TN (US)

( * ) Notice: Subject to any disclaimer, the term of this patent is extended or adjusted under 35 U.S.C. 154(b) by 0 days.

(21) Appl. No.: 16/993,694

(22) Filed: Aug. 14, 2020

(51) Int. Cl.

| | |
|---|---|
| ***F21V 23/00*** | (2015.01) |
| ***F21V 19/00*** | (2006.01) |
| ***F21V 23/06*** | (2006.01) |
| ***F21Y 115/10*** | (2016.01) |

(52) U.S. Cl.
CPC ..... *F21V 23/001* (2013.01); *F21V 19/003* (2013.01); *F21V 23/06* (2013.01); *F21Y 2115/10* (2016.08)

(58) Field of Classification Search
CPC ..... F21Y 2115/10; F21Y 2103/10; H01R 13/6271; H01R 25/14; H01R 25/142; H01R 25/147; A47F 3/001; A47F 11/10; G09F 13/04; F21V 23/001; F21V 23/06; F21V 19/003; F21V 21/34; F21V 21/35
See application file for complete search history.

(56) References Cited

U.S. PATENT DOCUMENTS

| | | | | |
|---|---|---|---|---|
| 4,864,475 | A * | 9/1989 | Jung | F21V 9/08 362/231 |
| 6,386,733 | B1 | 5/2002 | Ohkohdo et al. | |
| 7,210,957 | B2 | 5/2007 | Mrakovich et al. | |
| 7,290,913 | B2 | 11/2007 | Watanabe et al. | |
| 8,398,261 | B2 | 3/2013 | Nall et al. | |
| 8,876,336 | B2 | 11/2014 | Suzuki | |
| 9,311,835 | B2 * | 4/2016 | Breihof | G09F 13/04 |
| 9,537,275 | B2 * | 1/2017 | Ewing | H01R 25/142 |
| 9,587,814 | B2 | 3/2017 | Carney et al. | |
| 9,596,950 | B2 * | 3/2017 | Waalkes | A47F 7/02 |
| 9,851,054 | B2 | 12/2017 | Vincent | |
| D811,627 | S | 2/2018 | Roys | |
| 9,883,756 | B2 * | 2/2018 | Kraiss | A47F 11/10 |
| 9,945,541 | B1 | 4/2018 | Kuo | |
| 10,024,501 | B1 | 7/2018 | Vincent | |
| 10,094,523 | B2 | 10/2018 | Andrews | |
| 10,107,481 | B1 | 10/2018 | Chen | |
| 10,180,606 | B2 * | 1/2019 | Mullins | E06B 3/66 |

(Continued)

*Primary Examiner* — Peggy A Neils
(74) *Attorney, Agent, or Firm* — Emerson, Thomson & Bennett, LLC; Roger D. Emerson

(57) ABSTRACT

Provided in this disclosure is an electrical bus system for use with a box light. The system includes a mounting channel having a pair of bus bars that define positive and neutral electrical conductors for supplying electricity. Electrical modules are configured for variable positioning along the mounting channel. Each of the electrical modules includes an end cap configured to engage the mounting channel. A protrusion extends away from the end cap for insertion into the mounting channel and for securing the end cap to the mounting channel at a selected position. A pair of terminal sockets makes electrical contact with the bus bars. A socket receives and supports an electrical component, preferably an LED light stick. The socket supports electrical connections to the terminal sockets for receiving and supplying power to the electrical component.

18 Claims, 11 Drawing Sheets

(56) References Cited

U.S. PATENT DOCUMENTS

| | | | | |
|---|---|---|---|---|
| 10,222,005 | B2 | 3/2019 | Norton et al. | |
| 10,400,960 | B1 | 9/2019 | Vincent et al. | |
| 2002/0126064 | A1* | 9/2002 | Yen | G09G 3/32 345/5 |
| 2012/0124874 | A1 | 5/2012 | Roys et al. | |
| 2019/0293269 | A1 | 9/2019 | Roys et al. | |
| 2019/0309933 | A1 | 10/2019 | Norton et al. | |

* cited by examiner

LIGHT STICK BUS SYSTEM

1. BACKGROUND

A. Technical Field

This invention pertains to the field of bus systems including mechanical and electrical components for installing LED light sticks, particularly for use with a box sign,

B. Description of Related Art

Box signs are a common type of illuminated signage typically used for a variety of display purposes, including displaying a business name or corporate logo on the interior and/or exterior of a business, to announce the business and/or to attract prospective patrons. Box signs are also commonly used for advertising inside a business or at remote locations. In a commonplace example, a box sign includes a box frame, typically formed of aluminum, with translucent panels on front and/or back surfaces of the frame formed of a durable, flexible material such as acrylic or polycarbonate, capable of weather resistance for exterior implementations.

The translucent panels include indicia representing the logo or advertisement, typically formed on an internal side of the panels facing inwardly into the box frame. The indicia can be a decal or appliqué, screen printed image or image digitally printed directly onto the panel forming the sign face. Box signs are then internally illuminated with light sources inside the box frame to enable light to pass through the translucent panels and thus present the indicia to a viewer.

Traditional style box signs are illuminated from the inside using fluorescent tubes mounted with lamp holders and discrete wiring from a ballast to each lamp holder. With the recent advent of inexpensive, low-power LED light sources, it has become desirable to provide box sign illumination using LEI) light sticks, which are modules attached to an aluminum extrusion with electrical power supplied by a common bus system for providing power to all the light sticks from an LED Driver. This eliminates the discrete wiring of previous-type fluorescent fixtures and thereby simplifies design and manufacturing, representing a cost savings.

Current fluorescent designs require lamp holders to be mounted in specific positions within the box sign. Each lamp holder is then electrically connected to the ballast. The position of each lamp holder is a "best guess" to get proper light distribution. The positions of the lamp holders might need to be adjusted after assembly to obtain the desired light distribution. However, the lamp holders are typically screwed into the frame of the box sign at their respective positions. In this way, positional adjustments are very difficult in the current approach to lamp mounting because such adjustments require the entire assembly to be disassembled, leaving open screw holes in the frame from mounting at the previous positions. Also, extra wire must be allocated for each lamp socket in case subsequent adjustments are required.

In this manner, the current approach to lamp mounting is inefficient, requiring additional time and effort for "trial and error." Also, the current approach to lamp mounting results in potential damage to the frame, resulting in an undesirable end product, and consuming additional unnecessary materials, contributing to the overall cost. It would be beneficial to provide a box sign with improved adjustability that would not result in unnecessary damage or requiring the use of unneeded material.

II. SUMMARY

Provided in this disclosure is an electrical bus system for use with a box light. The system includes a mounting channel having a longitudinally-extending base portion and opposing side walls formed perpendicularly on longitudinally-extending of the base portion. A pair of bus bars are each secured to the respective opposing side walls of the mounting channel. The bus bars define positive and neutral electrical conductors for supplying electricity. One or more electrical modules are configured for variable positioning along the mounting channel. Each of the electrical modules includes an end cap having opposing first and second sides and a side wall portion between the opposing sides. The first side of the end cap is configured to engage the mounting channel. A protrusion extends away from the first side of the end cap for insertion into the mounting channel and for securing the end cap to the mounting channel at a selected position. A pair of terminals extends away from the first side of the end cap for respectively making electrical contact with the bus bars along the sides of the mounting channel. A socket is formed on the second side of the end cap, for receiving and supporting an electrical component, preferably an LED light stick. The socket supports electrical connections to the terminals for receiving and supplying power to the electrical component.

According to an aspect of the invention, an electrical bus system is provided that enables electrical components to be selectively positioned along the length of the bus system.

According to another aspect of the invention, an electrical bus system is provided that enables selective repositioning of electrical components without disassembling an entire assembly.

According to still another aspect of the invention, an electrical bus system is provided that enables electrical components to be repositioned without damaging the assembly.

According to yet another aspect of the invention, an electrical bus system is provided that allows trial and error repositioning of electrical components without additional drilling, cutting and wiring.

According to a further aspect of the invention, an electrical bus system is provided that enables electrical components to be repositioned without consuming additional unnecessary materials that contribute to the overall cost.

According to another further aspect of the invention, an electrical bus system in a box light system is provided that enables electrical light components to be selectively positioned to obtain the desired light distribution.

Other benefits and advantages of this invention will become apparent to those skilled in the art to which it pertains upon reading and understanding of the following detailed specification.

III. BRIEF DESCRIPTION OF THE DRAWINGS

The disclosed light stick bus system may take physical form in certain parts and arrangement of parts, embodiments of which will be described in detail in this specification and illustrated in the accompanying drawings which form a part hereof and wherein.

Figure 1:
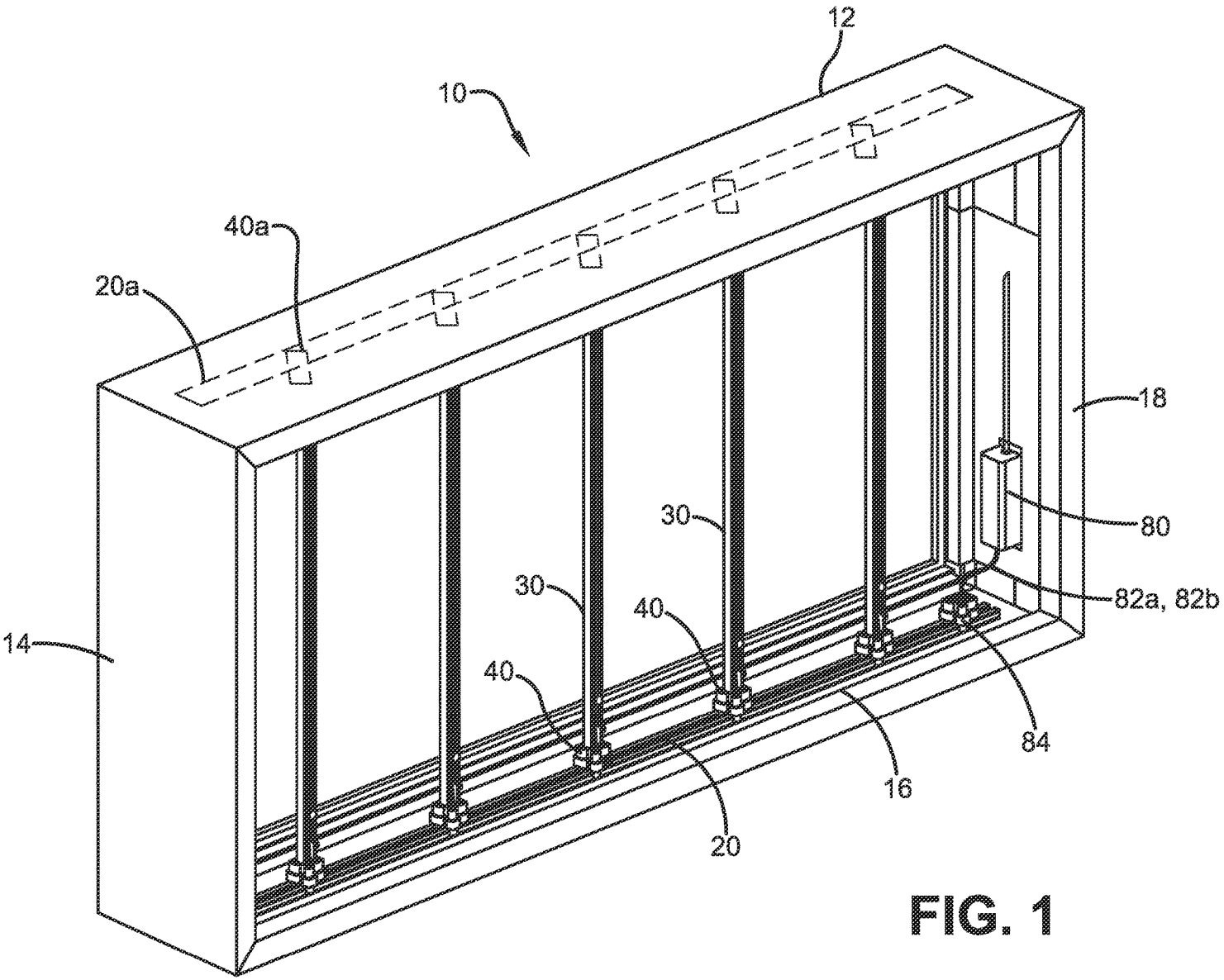
FIG. 1 is a perspective view of a box sign including a light stick configuration and bus system in accordance with an exemplary embodiment of the present invention.

FIGS. 4A, 4B, 4C, and 4D are perspective views depicting engagement of a light stick to a bus system using an electrical module in accordance with an exemplary embodiment of the present invention.

FIGS. 5A, 5B, 5C, and 5D are side views depicting the engagement of the light stick to the bus system using an electrical module in accordance with an exemplary embodiment of the present invention.

IV. DETAILED DESCRIPTION

Referring now to the drawings wherein the showings are for purposes of illustrating embodiments of the article only and not for purposes of limiting the same, and wherein like reference numerals are understood to refer to like components:

FIG. 1 shows an exemplary embodiment of a box light 10 that includes a frame 12. As depicted, the frame 12 is rectangular, having four flat sides 14. However, any suitable shape frame can be contemplated, having any number of sides or shapes of sides, without departing from the invention. In the preferred embodiment, the frame 12 can be formed of aluminum, but any suitable material can also be used in accordance with the invention. The frame 12 includes an interior surface 16 on one of the sides 14. The sides 14 also include a periphery 18 configured to support one or more translucent panels for displaying indicia, in the manner typical in the art, in accordance with the description presented hereinabove.

The box light 10 of FIG. 1 includes an electrical bus system having a mounting channel 20 secured to an interior surface 16 of the frame. The mounting channel 20 is generally longitudinal, extending in length with a continuous cross-sectional profile, such as typically formed by an extrusion process. As particularly shown in FIGS. 4A, 4B, 4C, 4D, 5A, 5B, 5C, and 5D, the mounting channel 20 has a longitudinally-extending base portion 20 and opposing first and second side walls 24*a*, 24*b* which are formed perpendicularly along the edges of longitudinally-extending first and second sides of the base portion 22.

In the preferred embodiment, the base portion 22 and the opposing first and second side walls 24*a*, 24*b* of the mounting channel 20 define a generally U-shaped cross-sectional configuration. In the preferred embodiment, the mounting channel 20 can be formed of a plastic material or other suitable electrical insulator. The base portion 22 of the mounting channel 20 is secured to the interior surface 16 of the frame 10 to hold it stable. The base portion 22 can be secured in any conventional manner, such as glue, screws, or other type of fasteners or adhesives.

As particularly shown in FIGS. 4A, 4B, 4C, 4D, 5A, 5B, 5C, and 5D, first and second bus bars 26*a*, 26*b* are secured to the respective opposing first and second side walls 24*a*, 24*b* of the mounting channel 20. In the preferred embodiment, the first and second bus bars 26*a*, 26*b* are secured to respective first and second exterior side wall surfaces of the side walls 24*a*, 24*b*, where it is appreciated that "exterior" refers to the outward facing sides of the side walls 24*a*, 24*b* with respect to the mounting channel 20, as opposed to "interior" which would be inside the mounting channel 20. In the preferred embodiment, the bus bars 26*a*, 26*b* are received and retained within recesses formed in the exterior surfaces of the side walls 24*a*, 24*b*. The bus bars 26*a*, 26*b* can be glued into these recesses. The first and second bus bars 26*a*, 26*b* define positive and neutral electrical conductors for supplying electricity to the bus system, as will be explained subsequently. In an alternate embodiment, the bus bars 26*a*, 26*b* can be placed on the interior surfaces of the side walls 24*a*, 24*b*.

Figure 2:
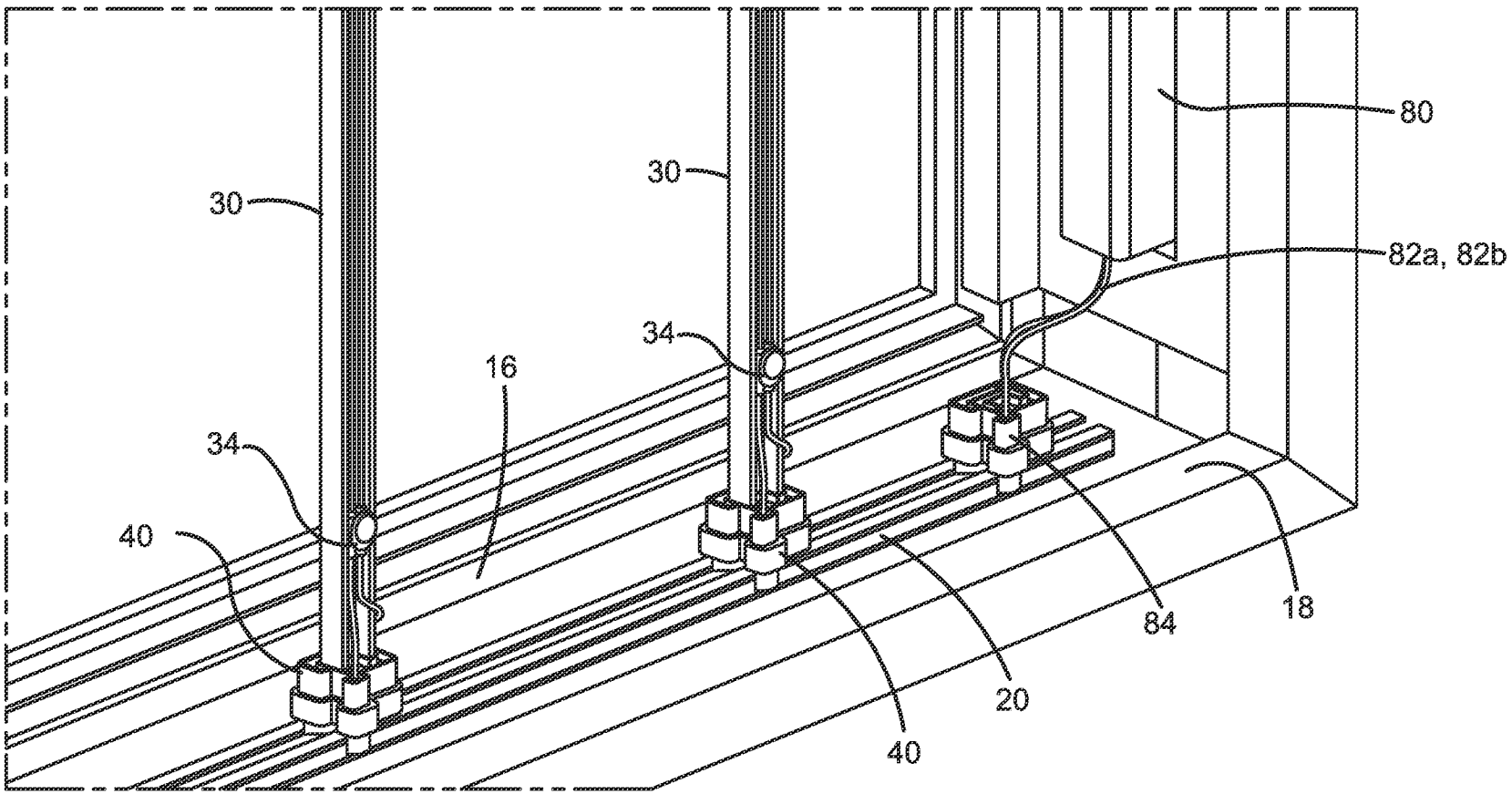
FIG. 2 is a perspective view revealing close-up details of the light stick configuration and bus system for the box sign of FIG. 1, in accordance with an exemplary embodiment of the present invention.
Figure 3:
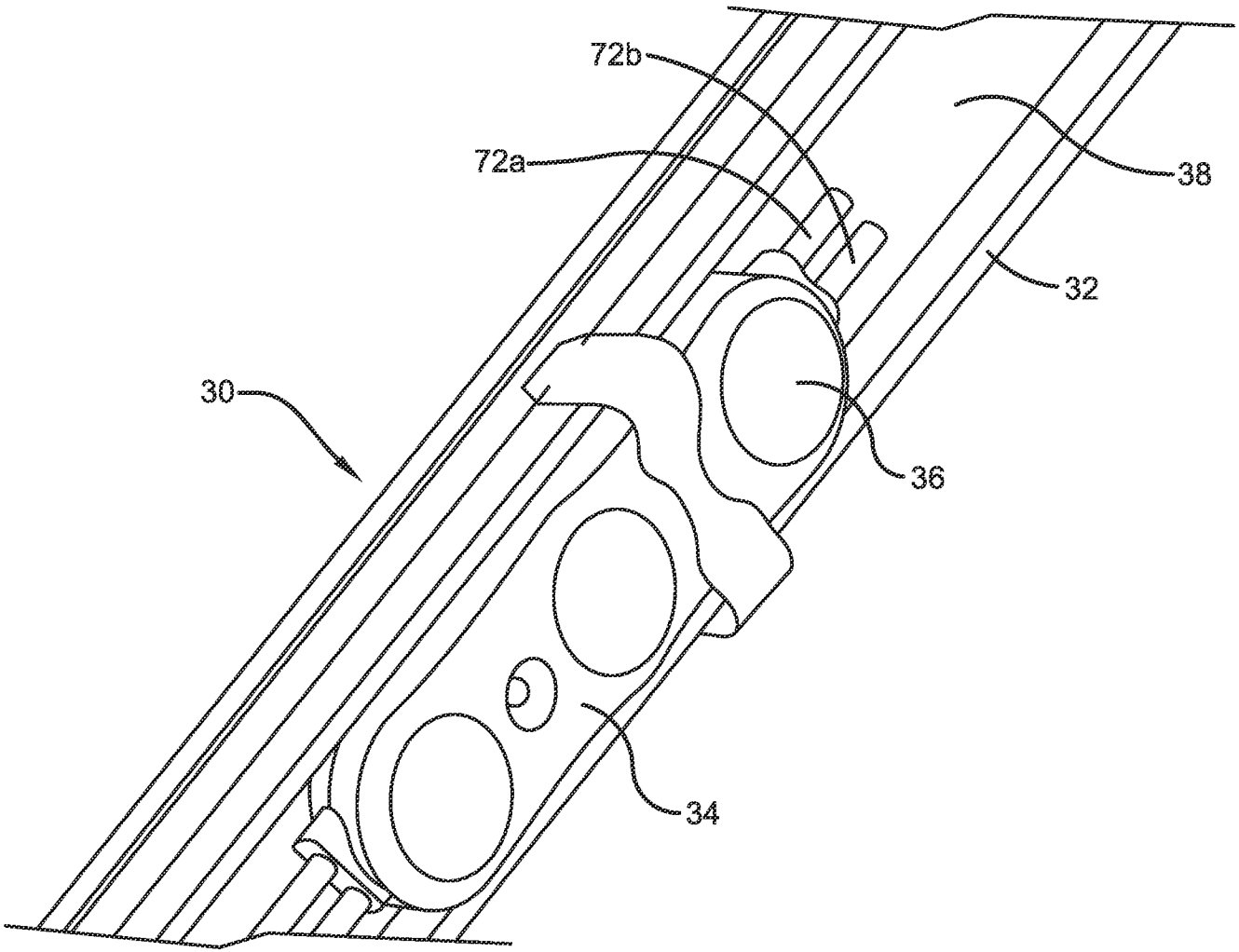
FIG. 3 is a perspective view of close-up details of a light stick with LED modules as used with the bus system for the box sign of FIG. 1 in accordance with an exemplary embodiment of the present invention.

As particularly shown in FIGS. 1, 2, and 3, one or more electrical components are provided each in the form of an LED light stick 30. The light stick 30 is formed as an aluminum extrusion 32 with one or more LED modules 34 attached along the length of the extrusion. The LED modules 34 each include one or more LED lamps 36 positioned along the length of the extrusion so that a plurality of LED lamps 36 are positioned along the length of the light stick 30. Each light stick 30 is configured for receiving electrical power from the bus bars 26*a*, 26*b*, as will be explained in detail hereinbelow. The light stick 30 is preferably assembled by attaching the LED modules 34 into light stick channels 38 on each side of the light stick 30. The LED modules 34 can be secured to the light stick channels 38 using double sided tape and/or mechanical clips or any other suitable fasteners or adhesives, as are known in the art.

In the preferred embodiment the LED light sticks 30 are the preferred type of electrical component for which the present electrical bus system is intended. However, it is to be appreciated that any suitable electrical component could be adapted for use with the present electrical bus system without departing from the invention.

As particularly shown in FIGS. 4A, 4B, 4C, 4D, 5A, 5B, 5C, and 5D, each electrical component (i.e., LEI) light stick 30) is electrically connected to the electrical bus system by an electrical module 40 configured for variable positioning along the mounting channel 20. As will be explained in detail hereinbelow, the electrical module 40 can removably engage the mounting channel 20 and be slid back and forth until a desirable position is determined, upon which it can be locked in place. If the electrical module 40 needs to be repositioned, it can be unlocked and slid to a different position on the mounting channel 20 and then locked at that position, without requiring disassembly or damage of any components.

As particularly shown in FIGS. 4A, 4B, 4C, 4D, 5A, 5B, 5C, and 5D, the electrical module 40 includes an end cap 42 having opposing first and second sides 42*a*, 42*b*, which are respectively a bottom side and a top side. The first side 42*a* (i.e. bottom) of the end cap 42 is configured to engage the mounting channel 20. In other words, the bottom of the end cap 42 rests on top of the side walls 24*a*, 24*b* of the mounting channel 20 while additional components of the electrical module 40 engage with other components of the mounting channel 20, as explained hereinbelow. The end cap 42 includes a side wall portion 42*c* between the first and second sides 42*a*, 42*b*. As shown in the figures, the end cap 42 has a substantially square configuration and the side wall portion 42*c* thus has four planar sides each spanning the distance between the first and second sides 42*a*, 42*b*. The substantially square end cap 42 has a width that matches a width of the mounting channel 20 between the side walls 24*a*, 24*b*, which enables engagement of the mechanical structures.

As further shown in FIGS. 4A, 4B, 4C, 4D, 5A, 5B, 5C, and 5D, the electrical module 40 also includes a protrusion 44 that secures the end cap 42 to the mounting channel 20, and first and second terminals 46*a*, 46*b* that make electrical contact with the bus bars 26*a*, 26*b*. The protrusion 44 is attached to the first side 42*a* of the end cap 42, that is, the bottom, and extends away from the first side 42*a* into the mounting channel 20. The protrusion 44 moveably secures the end cap 42 to the mounting channel 20 along a selected position of the mounting channel 20. The first and second terminal sockets 46*a*, 46*b* also extend away from the first side 42*a* of the end cap 42 for respectively making electrical contact with the first and second bus bars 26*a*, 26*b* along the sides of the mounting channel 20. The geometry of the design is such that a rotation (twist) of the end cap 42 secures the protrusion 44 and brings the terminal sockets 46*a*, 46*b* into electrical contact with the bus bars 26*a*, 26.

The series depicted in FIGS. 4A, 4B, 4C, 4D, SA, SB, 5C, and 5D illustrates the manner in which the electrical module 40 is brought into engagement with the mounting channel 20. The first and second terminal sockets 46*a*, 46*b* are located at catercorner positions of the substantially square end cap 42. The diagonal span between the terminal sockets 46*a*, 46*b* is greater than the width of the end cap 42, so that when the end cap 42 is oriented at an angle of 45 degrees, it is wider than the mounting channel 20. But when the end cap 42 is rotated into place, the width of the end cap 20 is equal to the width of the mounting channel 20 so that the terminal sockets 46*a*, 46*b* are placed into electrical contact with the respective first and second bus bars 26*a*, 26*b* since the width separating the terminal sockets 26*a*, 26*b* is equal to the width between the surfaces of the bus bars 26*a*, 26*b*. The first and second terminal sockets 46*a*, 46*b* of the end cap 44 have electrically conductive terminals 48*a*, 48*b* configured to make facing contact with the first and second bus bars 26*a*, 26*b*. In the preferred embodiment, all the conductive elements described herein are formed of copper or other suitable electrical conductor.

With continued reference to FIGS. 4A, 4B, 4C, 4D, 5A, 5B, 5C, and 5D, the opposing first and second side walls 24*a*, 24*b* also include respective first and second lip portions 50*a*, 50*b* that are attached to the open edges of the side walls, 24*a*, 24*b*, opposite from the edges that attach to the base 22. The first and second lip portions 50*a*, 50*b* are formed perpendicularly to the side walls 24*a*, 24*b*, and extend centrally over the mounting channel 20, toward the center of the mounting channel 20. These lip portions 50*a*, 50*b* define a securement structure for retaining the protrusion 44 within the mounting channel 20.

Figure 4A:
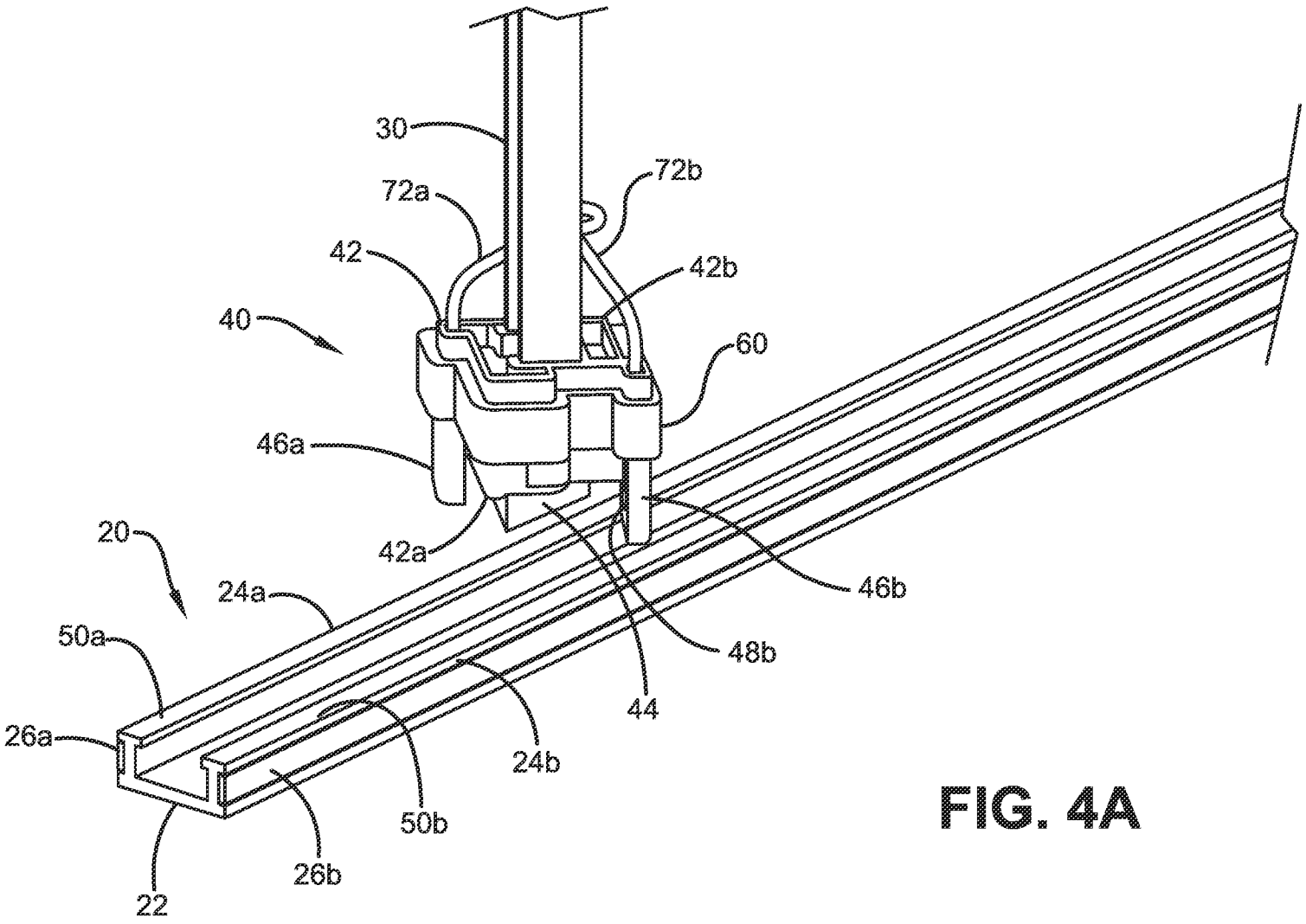
Figure 4B:
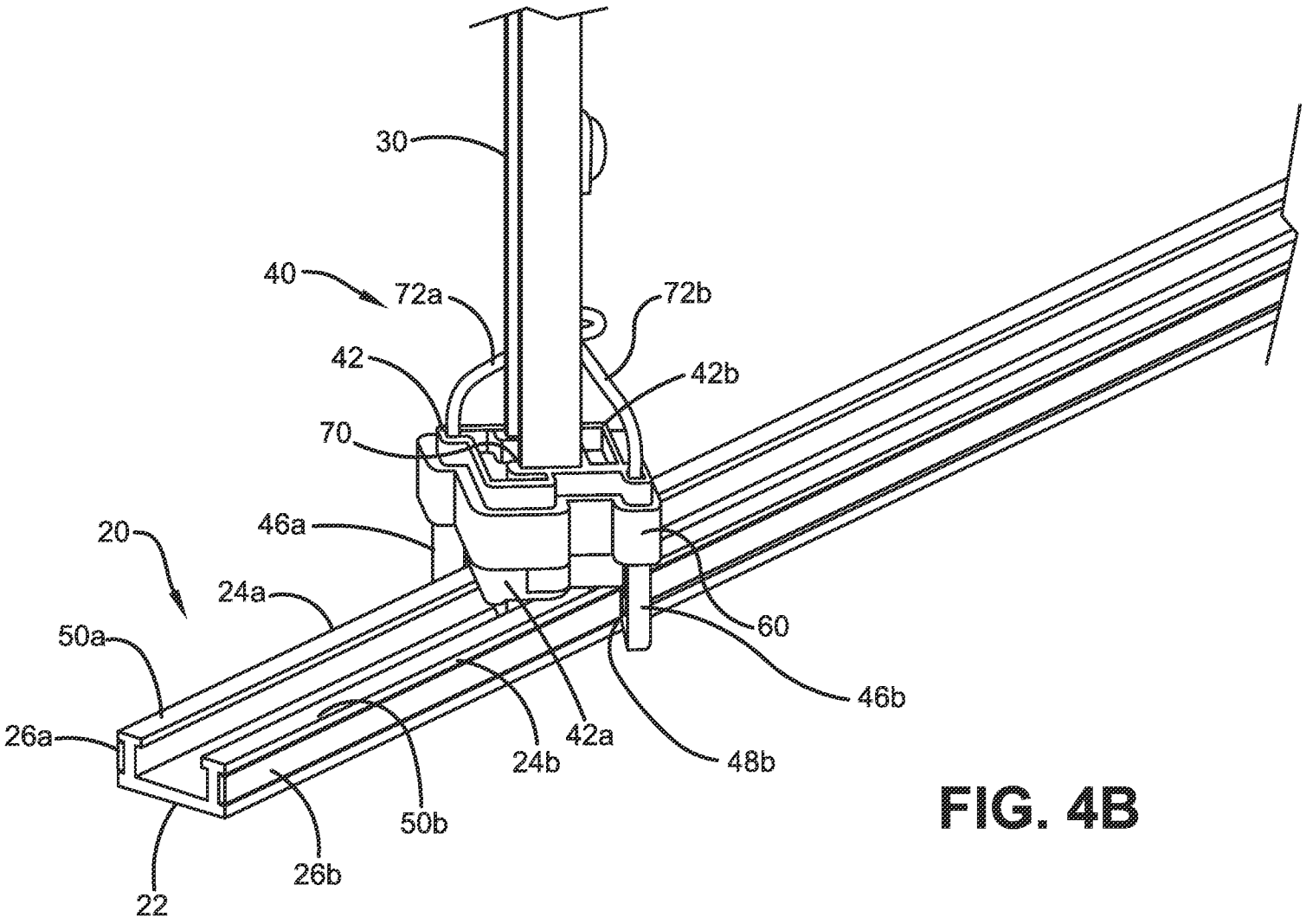
Figure 4C:
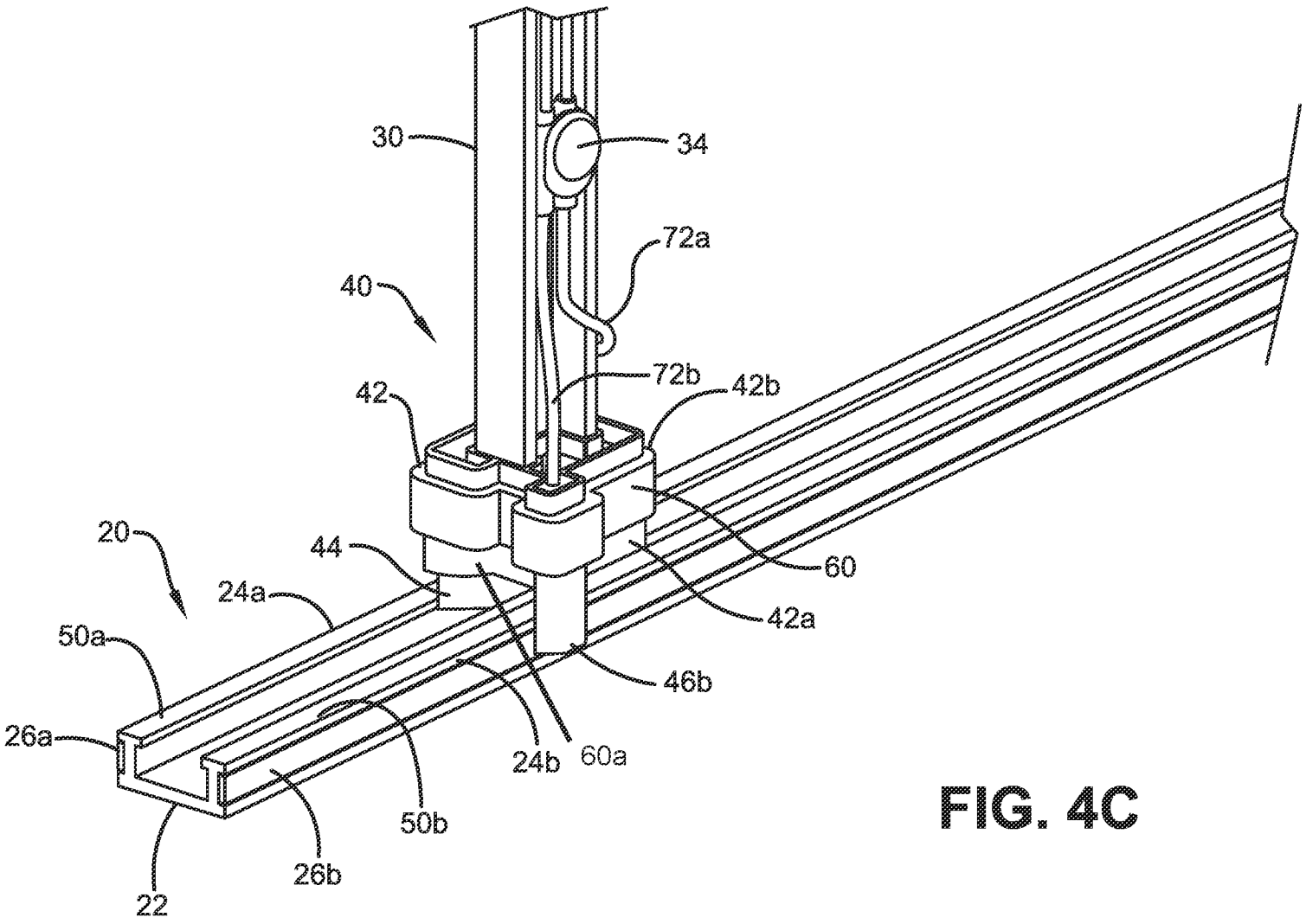
Figure 4D:
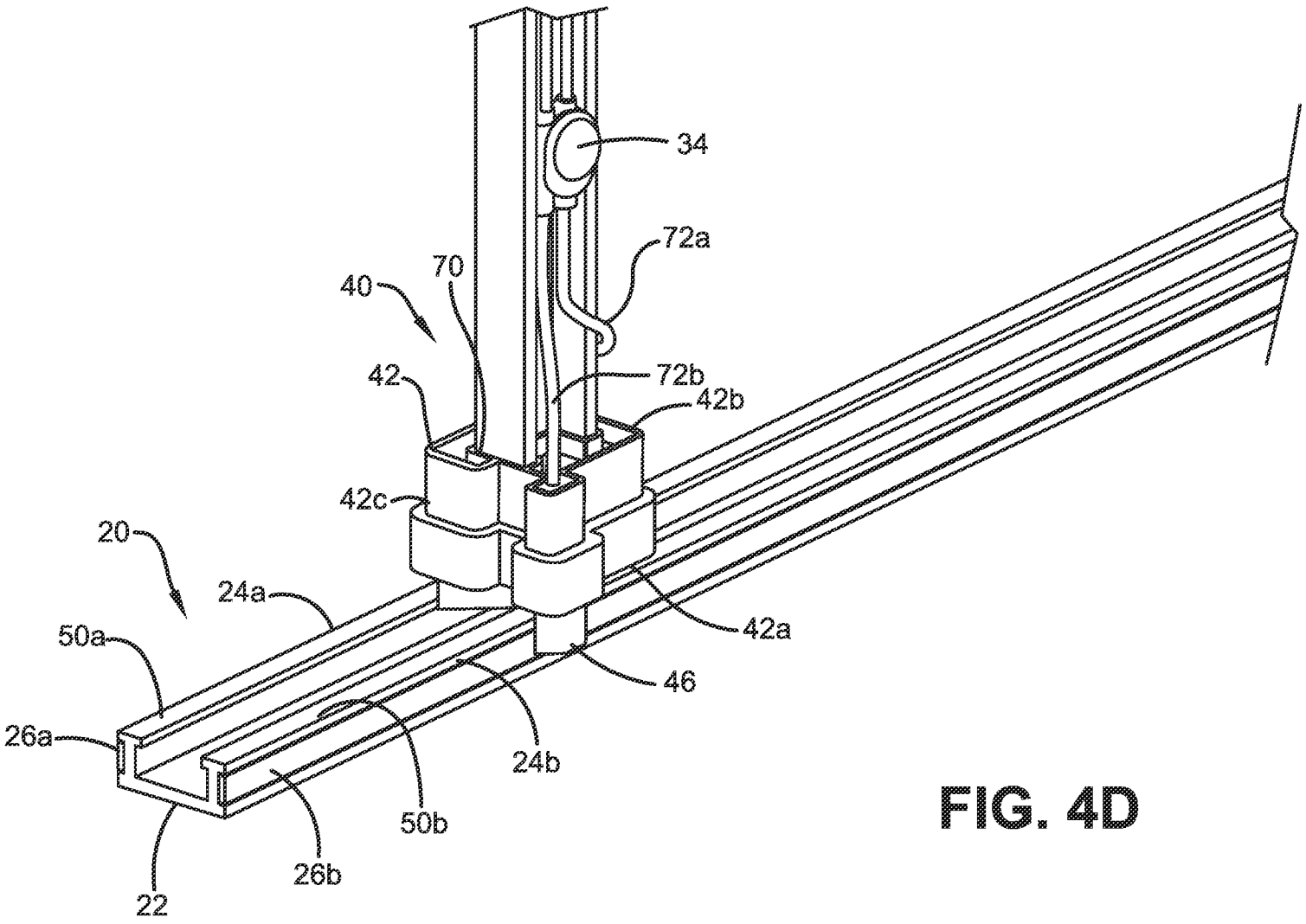
Figure 5A:
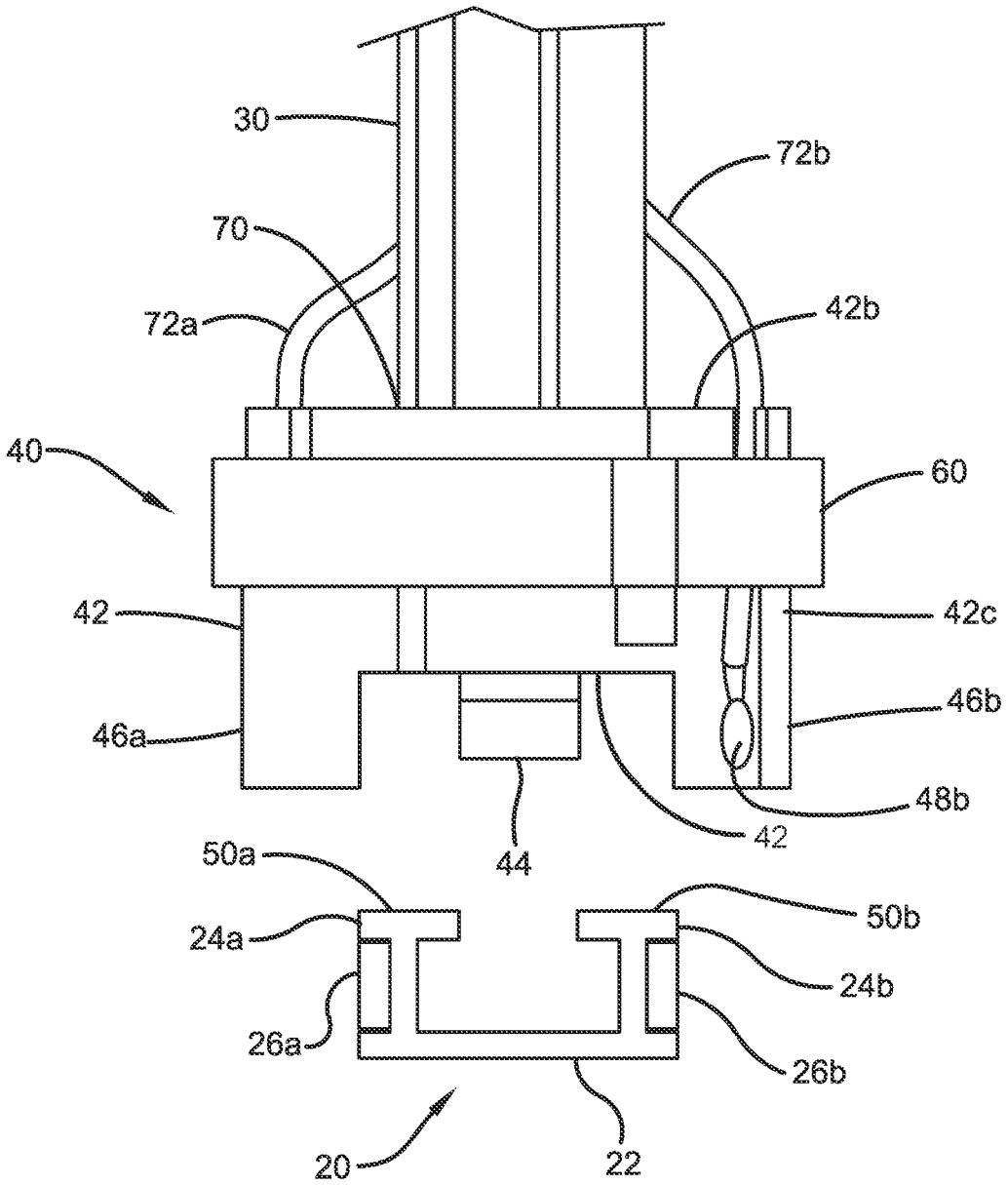
Figure 5B:
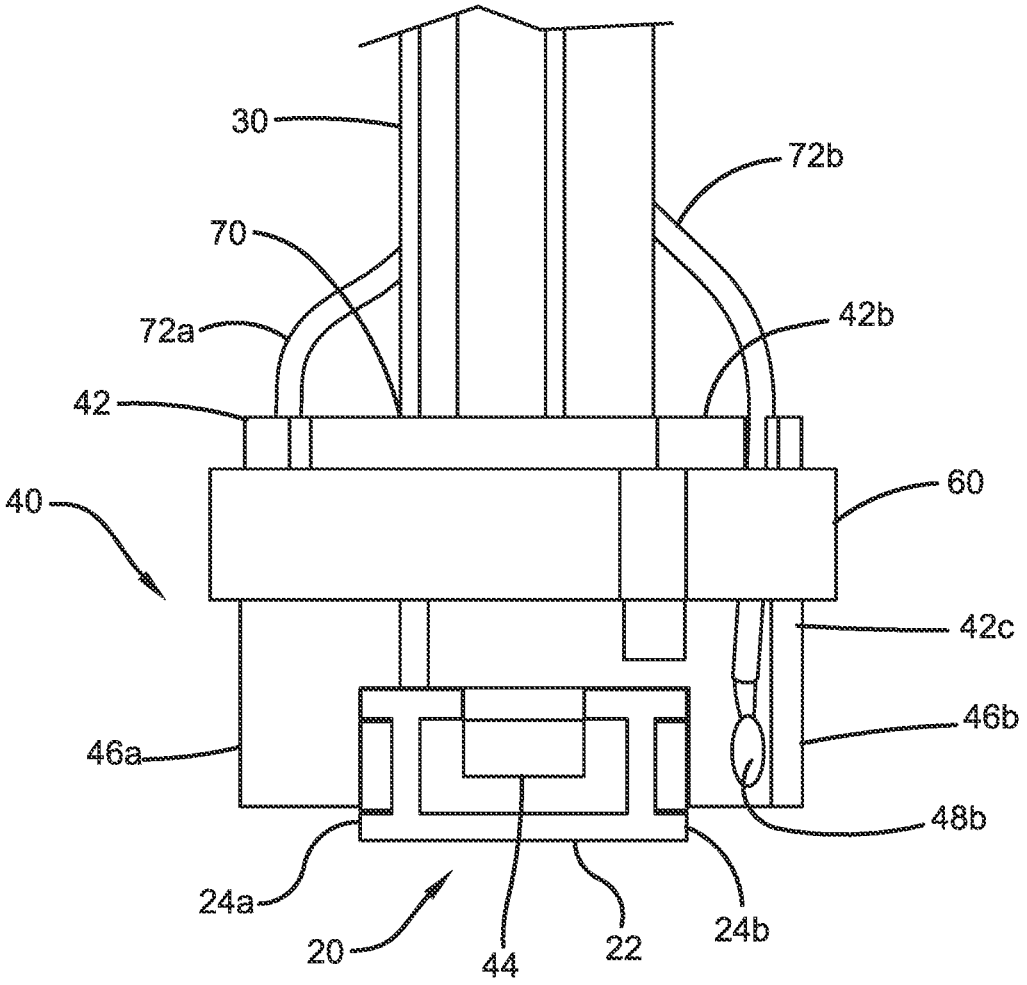
Figure 5C:
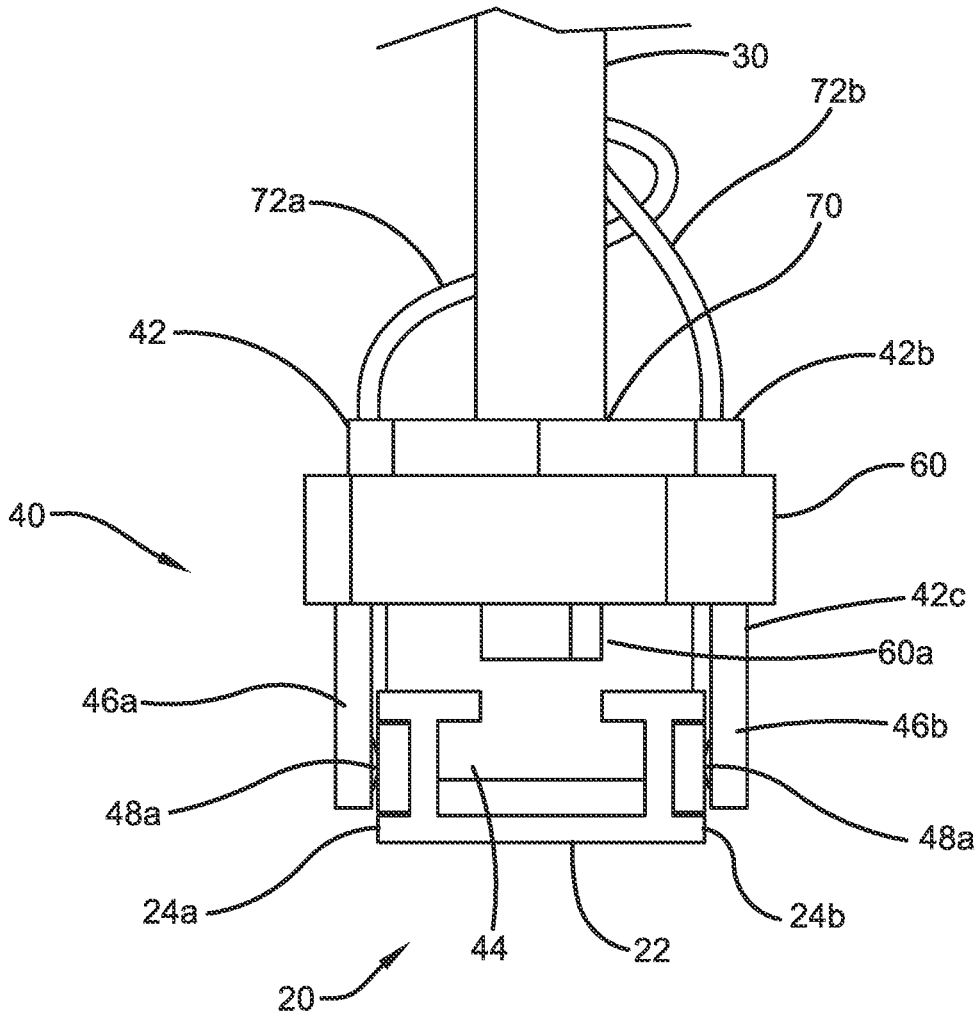
Figure 5D:
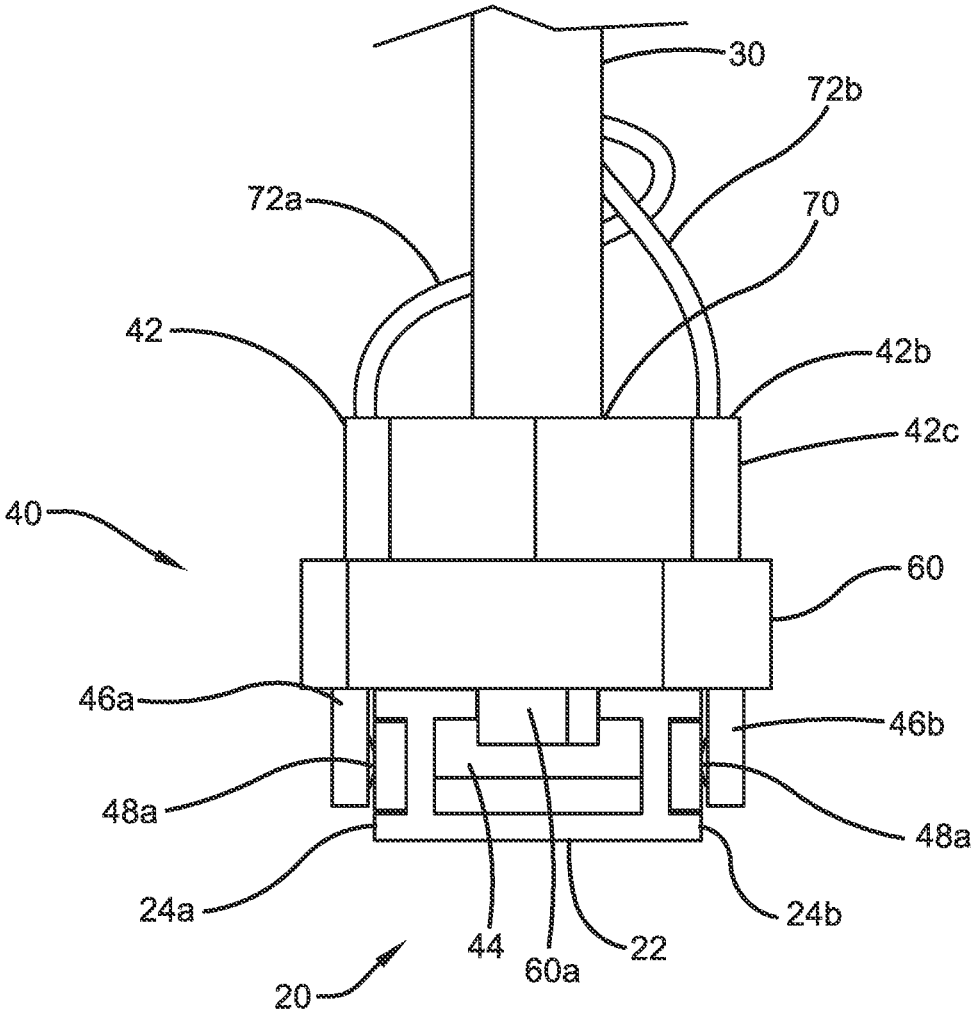

With continued reference to FIGS. 4A, 4B, 4C, 4D, 5A, 5B, 5C, and 5D, the protrusion 44 has a width and a thickness. The width is narrower than the mounting channel 20 and a thickness is sized to fit between the opposing first and second side walls 24*a*, 24*b* of the mounting channel 20. The protrusion 44 is oriented diagonally on the first side 42*a* (bottom) of the end cap 42 with respect to the substantially square end cap 42. In the preferred embodiment, the diagonal orientation is catercorner between opposite corners of the end cap 42 that do not have the terminal sockets 46*a*, 46*b*. The diagonal orientation of the protrusion 44 enables the width of the protrusion 44 to be inserted into the mounting channel 20 upon engagement of the first side 42*a* of the end cap 42 with the mounting channel 20, as best shown in FIGS. 5A and 5B. Upon rotation of the end cap 42, the thickness of the protrusion 44 rotates into a position where it engages the opposing first and second side walls 26*a*, 26*b* of the mounting channel 20. In this manner, the thickness is securely wedged between the side walls 26*a*, 26*b* as best shown in FIGS. 5C and 5D.

As especially apparent from FIGS. 5C and 5D, the protrusion 44 is generally T-shaped, having a tapered central post connected to the first side 42*a* of the end cap 42, where the central post is sized to fit within a gap between the first and second lip portions 50*a*, 50*b* atop the respective first and second side walls 24*a*, 24*b*. The T-shaped protrusion 44 thus extends centrally over the mounting channel 20, and is snugly retained between the side walls 24*a*, 24*b* and the lip portions 50*a*, 50*b*, to define a securement structure for retaining the protrusion 44 within the mounting channel 20. As best shown in FIG. 4A, the T-shaped protrusion 44 is oriented diagonally at a 45 degree angle with respect to the substantially square end cap 42 so that the end cap 42 is rotated 45 degrees to capture the protrusion 44 within the mounting channel 20 and also bring the first and second terminal sockets 46*a*, 46*b* into electrical contact with the respective first and second bus bars 26*a*, 26*b*, as described hereinabove. In the preferred embodiment, the profile of the T-shaped protrusion 44 and the mounting channel 20 are not symmetrical so the parts can only be assembled in only one orientation assuring that the positive contact from the light stick 30 mates with the positive side of the bus bar and the negative contact from the light stick 30 mates with the negative side of the bus bar.

As depicted in FIGS. 4C and 5C, once the end cap 42 is in proper position on the mounting channel 20 and the terminal sockets 46*a*, 46*b* are in contact with the bus bars 26*a*, 26*b*, a locking ring 60 that substantially surrounds the end cap 42 is displaced so that the locking ring 60 slides down over the first and second terminal sockets 46*a*, 46*b* as depicted in FIGS. 4D and 5D, to securely hold the terminal sockets 46*a*, 46*b* in place and prevent unwanted movement of the electrical module 40 within the mounting channel 20. The locking ring 60 includes a protrusion 60*a* which fits into the opening between the lid portions 50*a*, 5*b* to prevent rotation and secure the electrical connection.

As evident from FIGS. 1, 2, 3, 4A, 4B, 4C, 4D, 5A, 5B, 5C, and 5D, the electrical module 40 further includes a receptacle 70, formed on the second side 42*b* of the end cap 42. The receptacle 70 is a recess in the end cap 42 for receiving and supporting the light stick extrusion 32. The receptacle 70 supports suitable electrical leads 72*a*, 72*b* electrically connecting the LED modules 34 to the first and second terminal sockets 46*a*, 46*b* for receiving and supplying power to the LED modules 34 on the LED light stick 30.

As also evident from FIGS. 1, 2, 3, 4A, 4B, 4C, 4D, 5A, 5B, 5C, and 5D, the box light 10 with electrical bus system according to the present invention also includes suitable electrical connections. An LEI) driver 80 is mounted to an interior surface of the frame 12 and includes supply electrical leads 82*a*, 82*b*. These leads 82*a*, 82*b* of the driver 80 are inserted into the appropriate locations in an end cap 42 defining a supply module 84, similar to the electrical module 40 disclosed hereinabove, but not connected to an LED light stick 30. The supply module 84 with a locking ring 60 is placed at the end of the mounting channel 20 and connected to the bus bars 26*a*, 26*b*, twisted and locked it into position. The supply module 84 is thus electrically connected to the bus bars 26*a*, 26*b* for supplying the power from the LED driver 80 that is used by the modules 40 that power the LED light stick(s) 30.

With reference to FIG. 1, the mounting channel 20 is attached to an interior surface 16 on the bottom portion of the frame 14. As shown in phantom, a second mounting channel 20*a* can be attached to an interior surface of a top portion of the frame 14, opposite the mounting channel 20. Similarly, second modules 40*a* can be used to support the end of the light sticks 30 on the opposite side. The second mounting channel 20*a* and the second modules 40*a* are also formed of plastic and support the non-electrified end of the light sticks 30. The second modules 20*a* are thus not used for electrical supply and need not include bus bars or other electrical components, but are simply used to provide balanced mechanical support of the light sticks 30. The second modules 40*a* function in an identical manner to the electrical modules 40 and are defined by respective end caps mounted to the ends of the light sticks 30 and can be selectively positioned and repositioned to enable the desired light distribution of the LED light sticks 30. In this manner, more than one mounting channel can be employed where more than one module can be used to securely support both ends of each of the light sticks 30.

The series of illustrations of FIGS. 4A, 4B, 4C, 4D, 5A, 5B, 5C, and 5D depict a method of connecting the electrical components according to the present invention. As shown in the figures, a mounting channel 20 is provided having a longitudinally-extending base portion 22 and opposing first and second side walls 24*a*. 24*b* with respective first and second bus bars 26*a*, 26*b* secured thereto. The bus bars 26*a*, 26*b* define positive and neutral electrical conductors for supplying electricity, as explained hereinabove. An end cap 42 of an electrical module 40 is attached to an end of an LED light stick 30.

As especially indicated at FIGS. 4A, 4B, 5A, and 5B, a protrusion 44 is inserted into the mounting channel 20, in which the protrusion 44 is formed on the bottom 42*a* of the end cap 42 of the electrical module 40. The electrical module 40 supporting the light stick 30 is slid along the mounting channel 20 for positioning of the electrical module 40 at a desired position along the mounting channel 20.

As especially indicated at FIGS. 4C and 5C, the electrical module 40 supporting the light stick is rotated so that the protrusion 44 is captured within the mounting channel 20. In this same manner, the first and second terminal sockets 46*a*, 46*b*, formed on the end cap 42, are rotated into electrical contact with the first and second bus bars 26*a*, 26*b*. After that, as especially indicated at FIGS. 4D and 5D, the locking ring 60 is slid onto the end cap 42 and over the first and second terminal sockets 46*a*, 46*b* into the locked position to lock the electrical module 40 supporting the light stick 30 into the desired position on the mounting channel 20. The protrusion 60*a* of the locking ring 60 prevents rotation and secures the electrical connection.

As best shown in FIGS. 5B and 5C, the protrusion 44 is captured by the respective first and second lip portions 50*a*, 50*b*, atop the respective first and second side walls 24*a*, 24*h*, that extend centrally over the mounting channel 29, to define a securement structure for retaining the protrusion 44 within the mounting channel 20. Because of the diagonal orientation of the protrusion, the step of rotating includes rotating the electrical module 40 supporting the light stick 30 about 45 degrees.

In order to remove and reposition the electrical module 40 with the light stick 30, the steps depicted in the series of illustrations of FIGS. 4A, 4B, 4C, 4D, 5A, 5B, 5C, and 5D can be performed in reverse order and begins with sliding the locking ring 60 off the end cap 42 into an unlocked position. The electrical module 40 supporting the light stick 30 is rotated in an opposite direction so that the protrusion 44 is released from the mounting channel 20. In this manner, the first and second terminal sockets 46*a*, 46*b* are rotated out of electrical contact with the first and second bus bars 26*a*, 26*b*, The electrical module 40 is repositioned at a different position along the mounting channel 20. The electrical module 40 supporting the light stick 30 is repositioned again so that the protrusion 44 is captured by the mounting channel 20, is order that the first and second terminal sockets 46*a*, 46*b*, formed on the end cap 42, are rotated again into electrical contact with the first and second bus bars 26*a*, 26*b*. Afterwards, the locking ring 60 is slid again onto the end cap 42 and over the first and second terminal sockets 46*a*, 46*h* again to lock the electrical module 40 supporting the light stick 30 into the different position, to thereby receive power to illuminate the LED light stick 30.

It should also be appreciated that the present electrical bus system enables additional light sticks 30 to be added, to increase light output. Conversely, the present electrical bus system enables excess light sticks 30 to be removed to decrease light output, all in accordance with the needs of the box sign consumer. In the event that the additional light sticks 30 require additional power, multiple drivers 80 can be added as needed to provide the power necessary to light the box sign 10. The features of the various components of the present invention work together to provide an easily adjustable system for lighting the inside of a box sign 10, providing flexibility and without damaging the unit, as with previous systems.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed:

1. An electrical bus system, comprising:

a mounting channel having a longitudinally-extending base portion and opposing first and second side walls formed perpendicularly on longitudinally-extending first and second sides of the base portion, wherein the first and second side walls comprise respective first and second exterior side wall surfaces that are outward facing with respect to the mounting channel;

first and second bus bars secured to the respective first and second exterior side wall surfaces of the respective opposing first and second side walls of the mounting channel, wherein the first and second bus bars define positive and neutral electrical conductors for supplying electricity; and at least one electrical module configured for variable positioning along the mounting channel comprising:

an end cap having opposing first and second sides and a side wall portion between the first and second sides, wherein the first side of the end cap is configured to engage the mounting channel;

a protrusion extending away from the first side of the end cap for insertion into the mounting channel and for securing the end cap to the mounting channel at a selected position;

first and second terminal sockets extending away from the first side of the end cap for respectively making electrical contact with the first and second bus bars along the respective first and second exterior side wall surfaces of the respective first and second sides of the mounting channel, wherein the first and second terminal sockets of the end cap have electrically conductive terminals configured to make facing contact with the first and second bus bars;

a socket, formed on the second side of the end cap, for receiving and supporting an electrical component, wherein the socket supports electrical connections to the first and second terminal sockets for receiving and supplying power to the electrical component.

2. The electrical bus system of claim 1, wherein the base portion and the opposing first and second side walls of the mounting channel define a generally U-shaped cross-sectional configuration.

3. The electrical bus system of claim 1, wherein the opposing first and second side walls further comprise respective first and second lip portions that extend centrally over the mounting channel, to define a securement structure for retaining the protrusion within the mounting channel.

4. The electrical bus system of claim 1, wherein the end cap has a substantially square configuration and the side wall portion has four planar sides each spanning the first and second sides, wherein the substantially square end cap has a width matching a width of the mounting channel.

5. The electrical bus system of claim 4, wherein the first and second terminal sockets are located at catercorner positions of the substantially square end cap so that upon engagement of the first side of the end cap with the mounting channel, the end cap is rotated to bring the first and second terminal sockets into electrical contact with the respective first and second bus bars.

6. The electrical bus system of claim 4, wherein the protrusion has a width narrower than the mounting channel and a thickness sized to fit between the opposing first and second side walls of the mounting channel, and wherein the protrusion is oriented diagonally, with respect to the substantially square end cap so that the width of the protrusion is inserted into the mounting channel upon engagement of the first side of the end cap with the mounting channel and the thickness of the protrusion engages the opposing first and second side walls of the mounting channel.

7. The electrical bus system of claim 6, wherein the protrusion is generally T-shaped, having a tapered central post sized to fit between a gap between first and second lip portions atop the respective first and second side walls, and extending centrally over the mounting channel, to define a securement structure for retaining the protrusion within the mounting channel.

8. The electrical bus system of claim 6, wherein the protrusion is oriented diagonally at a 45 degree angle with respect to the substantially square end cap so that the end cap is rotated 45 degrees to bring the first and second terminal sockets into electrical contact with the respective first and second bus bars.

9. The electrical bus system of claim 6, further comprising a locking ring that substantially surrounds the end cap and slides down over the first and second terminal sockets and between first and second lip portions to securely hold them in place and prevent unwanted movement of the electrical module within the mounting channel.

10. The electrical bus system of claim 1, wherein the electrical component is an LED light stick, including a plurality of LED lamps positioned along a length of the light stick.

11. The electrical bus system of claim 1, wherein the electrical bus system is mounted within a box light comprising a frame having an interior surface and a periphery configured to support at least one translucent panel for displaying indicia.

12. A box light, comprising:

a frame having an interior surface and a periphery configured to support at least one translucent panel for displaying indicia;

a mounting channel having a longitudinally-extending base portion and opposing first and second side walls formed perpendicularly on longitudinally-extending first and second sides of the base portion, wherein the base portion is secured to the interior surface of the frame;

first and second bus bars secured to the respective opposing first and second side walls of the mounting channel, wherein the first and second bus bars define positive and neutral electrical conductors for supplying electricity;

an LED light stick, including a plurality of LED lamps positioned along a length of the light stick, and configured for receiving electrical power from the bus bars; and at least one electrical module configured for variable positioning along the mounting channel comprising:

an end cap having opposing first and second sides and a side wall portion between the first and second sides, wherein the first side of the end cap is configured to engage the mounting channel;

a protrusion extending away from the first side of the end cap into the mounting channel for moveably securing the end cap along a selected position of the mounting channel;

first and second terminal sockets extending away from the first side of the end cap for respectively making electrical contact with the first and second bus bars along the sides of the mounting channel;

a socket, formed on the second side of the end cap, for receiving and supporting the LED light stick, wherein the electrical socket support electrical connections to the first and second terminal sockets for receiving and supplying power to the LED light stick.

13. The electrical bus system of claim 12, wherein the mounting channel comprises at least one mounting channel mounted to at least one of a top or a bottom of the frame.

14. The electrical bus system of claim 13, comprising at least one end cap mounted to at least one end of the LED light stick, for engaging a respective the at least one mounting channel.

15. A method of connecting electrical components comprising:

providing a mounting channel having a longitudinally-extending base portion and opposing first and second side walls having respective first and second exterior side wall surfaces that are outward facing with respect to the mounting channel, with respective first and second bus bars secured to the respective first and second exterior side wall surfaces thereto that define positive and neutral electrical conductors for supplying electricity;

attaching an end cap of an electrical module to an end of an LED light stick;

inserting a protrusion, formed on the end cap of the electrical module, into the mounting channel;

positioning the electrical module at a desired position along the mounting channel;

rotating the electrical module supporting the light stick so that the protrusion is captured by the mounting channel, and so that first and second terminal sockets, formed on the end cap, are rotated into facing electrical contact with the first and second bus bars on the respective first and second exterior side wall surfaces, and sliding a locking ring onto the end cap and over the first and second terminal sockets to lock the electrical module supporting the light stick into the desired position.

16. The method of claim 15, further comprising capturing the protrusion by respective first and second lip portions atop the respective first and second side walls that extend centrally over the mounting channel, for retaining the protrusion within the mounting channel.

17. The method of claim 15, wherein the rotating comprises rotating the electrical module supporting the light stick about 45 degrees.

18. The method of claim 15, further comprising:

sliding the locking ring off the end cap;

rotating the electrical module supporting the light stick in an opposite direction so that the protrusion is released from the mounting channel, and so that the first and second terminal sockets are rotated out of electrical contact with the first and second bus bars;

repositioning the electrical module at a different position along the mounting channel;

rotating the electrical module supporting the light stick again so that the protrusion is captured by the mounting channel, and so that first and second terminal sockets, formed on the end cap, are rotated again into electrical contact with the first and second bus bars, and sliding the locking ring again onto the end cap and over the first and second terminal sockets again to lock the electrical module supporting the light stick into the different position.

* * * * *